US007542031B2

(12) United States Patent
Jo et al.

(10) Patent No.: US 7,542,031 B2
(45) Date of Patent: Jun. 2, 2009

(54) CURRENT SUPPLY CIRCUIT, CURRENT SUPPLY DEVICE, VOLTAGE SUPPLY CIRCUIT, VOLTAGE SUPPLY DEVICE, ELECTRO-OPTICAL DEVICE, AND ELECTRONIC APPARATUS

(75) Inventors: Hiroaki Jo, Suwa (JP); Toshiyuki Kasai, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 701 days.

(21) Appl. No.: 11/104,626

(22) Filed: Apr. 13, 2005

(65) Prior Publication Data

US 2005/0259099 A1 Nov. 24, 2005

(30) Foreign Application Priority Data

May 24, 2004 (JP) ..... 2004-153279

(51) Int. Cl.
*G09G 5/00* (2006.01)

(52) U.S. Cl. ..... 345/211; 345/213

(58) Field of Classification Search ..... 345/211–213
See application file for complete search history.

(56) References Cited

U.S. PATENT DOCUMENTS 5,744,986 A * 4/1998 Yamada et al. ..... 327/95
6,747,417 B2 6/2004 Meade et al.
7,102,600 B2 9/2006 Kasai
7,113,156 B2 9/2006 Hashimoto
2002/0084812 A1 7/2002 Nishitoba
2006/0152453 A1 7/2006 Hashimoto

FOREIGN PATENT DOCUMENTS

JP A 07-013530 1/1995
JP A 2001-042821 2/2001
JP A 2002-202823 7/2002
JP A 2003-131618 5/2003
JP A 2003-131620 5/2003
JP A 2003-288045 10/2003
JP A 2003-295828 10/2003
JP A 2004-302273 10/2004

* cited by examiner

*Primary Examiner*—Amr Awad
*Assistant Examiner*—Randal Willis
(74) *Attorney, Agent, or Firm*—Oliff & Berridge, PLC

(57) ABSTRACT

To reduce the variation of luminance between driving modules. Driving modules DR1 to DR3 each have monitor current output circuits, and output monitor current signals MI12, MI21, MI22, and MI31. A monitor unit of a control circuit converts the monitor current signals into monitor data D12, D21, D22, and D31, respectively, and supplies them to a control data generating unit. The control data generating unit generates current control data CTL1 to CTL3 such that the values of the respective monitor current signals are equal to each other and supplies them to the driving modules DR1 to DR3.

4 Claims, 13 Drawing Sheets

CURRENT SUPPLY CIRCUIT, CURRENT SUPPLY DEVICE, VOLTAGE SUPPLY CIRCUIT, VOLTAGE SUPPLY DEVICE, ELECTRO-OPTICAL DEVICE, AND ELECTRONIC APPARATUS

BACKGROUND

The present invention relates to a current supply circuit, a current supply device, a voltage supply circuit, a voltage supply device, an electro-optical device, and an electronic apparatus.

In recent years, a device that has an organic light emitting diode (hereinafter, referred to as an OLED element) has attracted considerable attention as an electro-optical device instead of a liquid crystal display device. The OLED element has an electrical operating feature of a diode and an optical operating feature of emitting light at the time of a forward bias, allowing luminance to be increased with an increase in a forward bias current.

An electro-optical device in which the OLED elements are arranged in a matrix has a plurality of scanning lines and a plurality of data lines, and pixel circuits are provided at intersections between the scanning lines and the data lines. Each pixel circuit has a thin film transistor (TFT) for supplying a current to each OLED element. A gray scale signal corresponding to a display gray scale level is supplied from a data line driving circuit to the data lines. In this case, a plurality of driving modules may constitute the data line driving circuit.

In such an electro-optical device, since the variation between currents flowing through the OLED elements occurs due to a difference in transistor properties between driving modules, it is difficult for a display device to emit light with uniform luminance. As a technique for improving the variance between the driving modules, there has been known a method of providing a circuit for generating a reference current and of using the reference current between a plurality of driving modules in common (for example, see Patent Document 1).

In addition, there has also been disclosed a method of separately providing a dummy digital-to-analog (DA) converter from a D/A converter for supplying a current to the data lines to be driven, and of using the current output from the dummy D/A converter as a common reference current between the plurality of driving modules (for example, see Patent Document 2).

In addition, there has also been disclosed a method of adding currents output from two adjacent D/A converters at the boundaries between the driving modules to drive the targets (for example, see Patent Document 3).

[Patent Document 1] Japanese Unexamined Patent Application Publication No. 2002-202823.

[Patent Document 2] Japanese Unexamined Patent Application Publication No. 2003-288045.

[Patent Document 3] Japanese Unexamined Patent Application Publication No. 2001-42821.

SUMMARY

However, according to the techniques of using the reference current between the plurality of driving modules in common as disclosed above, it is necessary to route the reference current between the plurality of driving modules. Therefore, the reference current supplied is multiplied by a predetermined ratio using a current mirror circuit in each driving module. Thus, in many cases, the reference current routed is very small.

When a small amount of reference current is routed between the plurality of driving modules, the precision of D/A conversion is deteriorated due to a bad effect of a noise overlapping wire lines. In addition, when the current mirror circuit is employed, the value of the reference current may be out of its range. In addition, it is difficult to realize uniformity luminance outside the boundaries between the driving modules only by adding the output currents at the boundaries.

Accordingly, the present invention is designed to solve the above-mentioned problems, and it is an object of the present invention to provide a current supply circuit, a current supply device, a voltage supply circuit, a voltage supply device, an electro-optical device, and an electronic apparatus, capable of reducing a difference in luminance between driving modules.

In order to achieve the above-mentioned object, the present invention provides a current supply circuit comprising a plurality of current output circuits for respectively supplying current signals to targets to be driven; one or more monitor current output circuits for outputting monitor current signals; and a current adjusting circuit for collectively adjusting gains of the one or more monitor current output circuits and the plurality of current output circuits. According to the present invention, the gains of the monitor current output circuit and the current output circuit are collectively adjusted, so that it is possible to adjust the current signal to be supplied to the drive target in consideration of the properties of the current output circuit when the current adjusting circuit is controlled based on the monitor current signal. In this case, the monitor current output circuit is not necessarily the same as the current output circuit. However, it is preferable to constitute the monitor current output circuit using transistors with the same performance. Accordingly, it is possible to estimate the properties of the current output circuit by means of the monitor current signal to adjust the current output signal. In addition, one driving module may constitute the current supply circuit.

In this case, preferably, the current adjusting circuit supplies an adjusted reference voltage to the plurality of current output circuits and the one or more monitor current output circuits, and the current output circuit and the monitor current output circuit each include a plurality of current sources for respectively outputting currents based on the reference voltage; and selection output means for selecting the respective currents output from the plurality of current sources, based on the input data, and for synthesizing the selected currents to output them as the current signal. In this case, the value of a current flowing through the current source is adjusted by varying the reference voltage. In addition, the reference voltage may be generated by, for example, reference current generating means for generating the reference current to be a value corresponding to control data and reference voltage generating means for converting the reference current into a reference voltage.

In addition, the present invention provides a current supply circuit including a plurality of current output circuits for respectively supplying current signals to targets to be driven; selection means for selecting whether to supply the current signals output from some or all of the current output circuits to the targets to be driven or to output them as monitor current signals; and a current adjusting circuit for collectively adjusting gains of the plurality of current output circuits. According to the present invention, a monitor current output circuit for generating the monitor current signal is not required, so that it is possible to simplify the configuration thereof. In addition, the signal from the current output circuit is output as the monitor current signal, so that a monitor having high precision may be implemented.

In another current supply circuit, preferably, the current adjusting circuit supplies an adjusted reference voltage to the plurality of current output circuits, and each current output circuit includes a plurality of current sources for respectively outputting currents based on the reference voltage; and selection output means for selecting the respective currents from the plurality of current sources, based on the input data, and for synthesizing the selected currents to output them as the current signal. In this case, the value of a current flowing through the current source is adjusted by varying the reference voltage.

In addition, the current supply circuit preferably has variable means for varying the levels of the monitor current signals to output them to the outside. When the signal level of the monitor current signal is high, the variable means is more resistant against noises, and the precision when AD-converting the monitor current signal may be enhanced. On the contrary, when the signal level of the monitor current signal is low, an effect on other facts, such as noise and power supply variation, may be reduced, and power consumption may be reduced. The variable means may include, for example, a current mirror circuit for having the monitor current signal as a reference current, may convert the signal level of the monitor current signal at a predetermined ratio to output it to the outside, or may add the monitor current signals to output the added signal to the outside.

Next, a current supply device according to the present invention includes a plurality of the current supply circuits described above, and control means for controlling the current adjusting circuits of the plurality of current supply circuits such that the values of the plurality of monitor current signals are close to each other, based on the plurality of monitor current signals output from the plurality of current supply circuits. According to the present invention, a difference in property between the plurality of current supply circuits may be corrected by feeding back the monitor current signals to the control means.

In addition, the control means has a plurality of conversion means each converting each of the monitor current signals into a digital signal to output it as monitor data, and controls the current adjusting circuits of the plurality of current supply circuits such that the values of the plurality of monitor current signals are close to each other, based on the respective monitor data output from the plurality of conversion means. In this case, the control means may treat the monitor current signal as monitor data, so that it is possible to perform an operating process.

Further, the control means includes selection means for sequentially selecting the plurality of monitor current signals to output them; and conversion means for converting the monitor current signals output from the selection means into digital signals to output them as monitor data. In addition, the control means controls the current adjusting circuits of the plurality of current supply circuits such that the values of the plurality of monitor current signals are close to each other, based on the monitor data output from the conversion means. According to the present invention, the selection means sequentially selects the monitor current signals to output them. Therefore, it is possible to use the conversion means in a time division manner. As a result, it is possible to reduce the number of conversion means. In this case, the conversion means may have current-to-voltage conversion means for converting the monitor current signal to a voltage and for outputting it as a monitor voltage signal and A/D conversion means for converting the monitor voltage signal to a digital signal and for outputting it as monitor data.

In addition, preferably, the control means repeatedly performs a first process of specifying one current supply circuit among the plurality of current supply circuits and of controlling the current adjusting circuit of the specified current supply circuit such that the value of the monitor data corresponding to the current supply circuit is close to a predetermined value; and a second process of controlling the current adjusting circuit of the current supply circuit adjacent to the previous current supply circuit having been controlled such that the value of the monitor data corresponding to the current supply circuit is close to the value of the monitor data corresponding to the previous current supply circuit having been controlled, thereby controlling the values of the monitor current signals output from all the current supply circuits so as to be close to each other. According to the present invention, the property of a certain current supply circuit is set and properties of adjacent current supply circuits are set to match the property of the current supply circuit, so that properties between the current supply circuits adjacent to each other may be close to each other.

In addition, the control means controls the respective current adjusting circuits of the plurality of current supply circuits such that the values of the respective monitor data corresponding to the plurality of current supply circuits are close to a predetermined value. According to the present invention, the properties of all the current supply circuits are set to be close a set value, which makes it possible to reduce the difference in property between the current supply circuits.

Next, a voltage supply circuit according to the present invention includes: a plurality of voltage output circuits for respectively supplying voltage signals to targets to be driven; one or more monitor voltage output circuits for outputting monitor voltage signals; and a voltage adjusting circuit for collectively adjusting gains of the one or more monitor voltage output circuits and the plurality of voltage output circuits. According to the present invention, the gains of the monitor voltage output circuit and the voltage output circuit are collectively adjusted, so that it is possible to adjust the voltage signal to be supplied to the drive target in consideration of the properties of the voltage output circuit when the voltage adjusting circuit is controlled based on the monitor voltage signal. In this case, the monitor voltage output circuit is not necessarily the same as the voltage output circuit. However, it is preferable to constitute the monitor voltage output circuit using transistors with the same performance. Accordingly, it is possible to estimate the properties of the voltage output circuit by means of the monitor voltage signal to adjust the voltage output signal. In addition, one driving module may constitute the voltage supply circuit.

In addition, another voltage supply circuit according to the present invention includes: a plurality of voltage output circuits for respectively supplying voltage signals to targets to be driven; selection means for selecting whether to supply the voltage signals output from some or all of the voltage output circuits to the targets to be driven or to output them as monitor voltage signals; and a current adjusting circuit for collectively adjusting gains of the plurality of voltage output circuits. According to the present invention, a monitor voltage output circuit for generating the monitor voltage signal is not required, so that a simple configuration can be obtained. In addition, the signal from the voltage output circuit is output as the monitor voltage signal, so that a monitor having high precision may be implemented.

Further, the voltage supply circuit preferably has variable means for varying the levels of the monitor voltage signals to output them to the outside. When the signal level of the monitor voltage signal is high, the variable means is more resistant against noises, and the precision when AD-converting the monitor voltage signal may be enhanced. On the contrary, when the signal level of the monitor voltage signal is low, an effect on other facts, such as noise and power supply variation, may be reduced, and power consumption may be reduced.

Next, a voltage supply device according to the present invention includes a plurality of the current supply circuits as described above; and control means for controlling the voltage adjusting circuits of the plurality of voltage supply circuits such that the values of the plurality of monitor voltage signals are close to each other, based on the plurality of monitor voltage signals output from the plurality of voltage supply circuits. According to the present invention, it is possible to correct a difference in property between the voltage supply circuits by feeding back the monitor voltage signals to the control means.

In addition, preferably, the control means has a plurality of conversion means each converting each of the monitor voltage signals into a digital signal to output it as monitor data, and controls the voltage adjusting circuits of the plurality of voltage supply circuits such that the values of the plurality of monitor voltage signals are close to each other, based on the respective monitor data output from the plurality of conversion means. In this case, the control means may treat the monitor voltage signal as monitor data, so that it is possible to perform an operating process.

In addition, preferably, the control means includes selection means for sequentially selecting the plurality of monitor voltage signals to output them; and conversion means for converting the monitor voltage signals output from the selection means into digital signals to output them as monitor data. In addition, the control means controls the voltage adjusting circuits of the plurality of voltage supply circuits such that the values of the plurality of monitor voltage signals are close to each other, based on the monitor data output from the conversion means. According to the present invention, the selection means sequentially selects the monitor voltage signals to output them, so that it is possible to use the conversion means in a time division manner. As a result, the number of conversion means may be decreased.

In addition, preferably, the control means repeatedly performs a first process of specifying one voltage supply circuit among the plurality of voltage supply circuits and of controlling the voltage adjusting circuit of the specified voltage supply circuit such that the value of the monitor data corresponding to the voltage supply circuit is close to a predetermined value; and a second process of controlling the voltage adjusting circuit of the voltage supply circuit adjacent to the previous voltage supply circuit having been controlled such that the value of the monitor data corresponding to the voltage supply circuit is close to the value of the monitor data corresponding to the previous voltage supply circuit having been controlled, thereby controlling the values of the monitor voltage signals output from all the voltage supply circuits so as to be close to each other. According to the present invention, the property of a certain voltage supply circuit is set and the properties of adjacent voltage supply circuits are set to correspond to the property of the voltage supply circuit, so that the properties between the voltage supply circuits adjacent to each other may be close to each other.

Further, the control means controls the respective voltage adjusting circuits of the plurality of voltage supply circuits such that the values of the respective monitor data corresponding to the plurality of voltage supply circuits are close to a predetermined value. According to the present invention, the properties of all the voltage supply circuits are set to be close a set value, which makes it possible to reduce a difference in property between the voltage supply circuits.

Next, an electro-optical device according to the present invention includes a plurality of scanning lines; a plurality of data lines; a plurality of pixel circuits provided at intersections of the scanning lines and the data lines, each having an electro-optical element and a circuit for driving the electro-optical element based on a driving signal supplied from the data line; and the current supply device as described above, wherein the plurality of current supply circuits are connected to the plurality of data lines, respectively, and the input data is image data. According to the present invention, a plurality of current supply circuits is employed when current signals as drive signals are supplied to the plurality of data lines. Further, the properties between the current supply circuits may be adjusted to be close to each other, based on the monitor current signal, so that it is possible to make the luminance of the entire screen uniform.

Next, another electro-optical device according to the present invention includes a plurality of scanning lines; a plurality of data lines; a plurality of pixel circuits provided at intersections of the scanning lines and the data lines, each having an electro-optical element and a circuit for driving the electro-optical element based on a driving signal supplied from the data line; and the voltage supply device as described above, wherein the plurality of voltage supply circuits are connected to the plurality of data lines, respectively, and the input data is image data. According to the present invention, a plurality of voltage supply circuits is employed when voltage signals as drive signals are supplied to the plurality of data lines. Further, the properties between the voltage supply circuits may be adjusted to be close to each other, based on the monitor voltage signal, so that it is possible to make the luminance of the entire screen uniform.

Next, an electronic apparatus according to the present invention has the electro-optical device as described above. The electronic apparatus includes, for example, a personal computer, a cellular phone, a personal digital assistant (PDA), an electronic still camera, and so forth.

DETAILED DESCRIPTION OF EMBODIMENTS

1. First Embodiment

Figure 1:
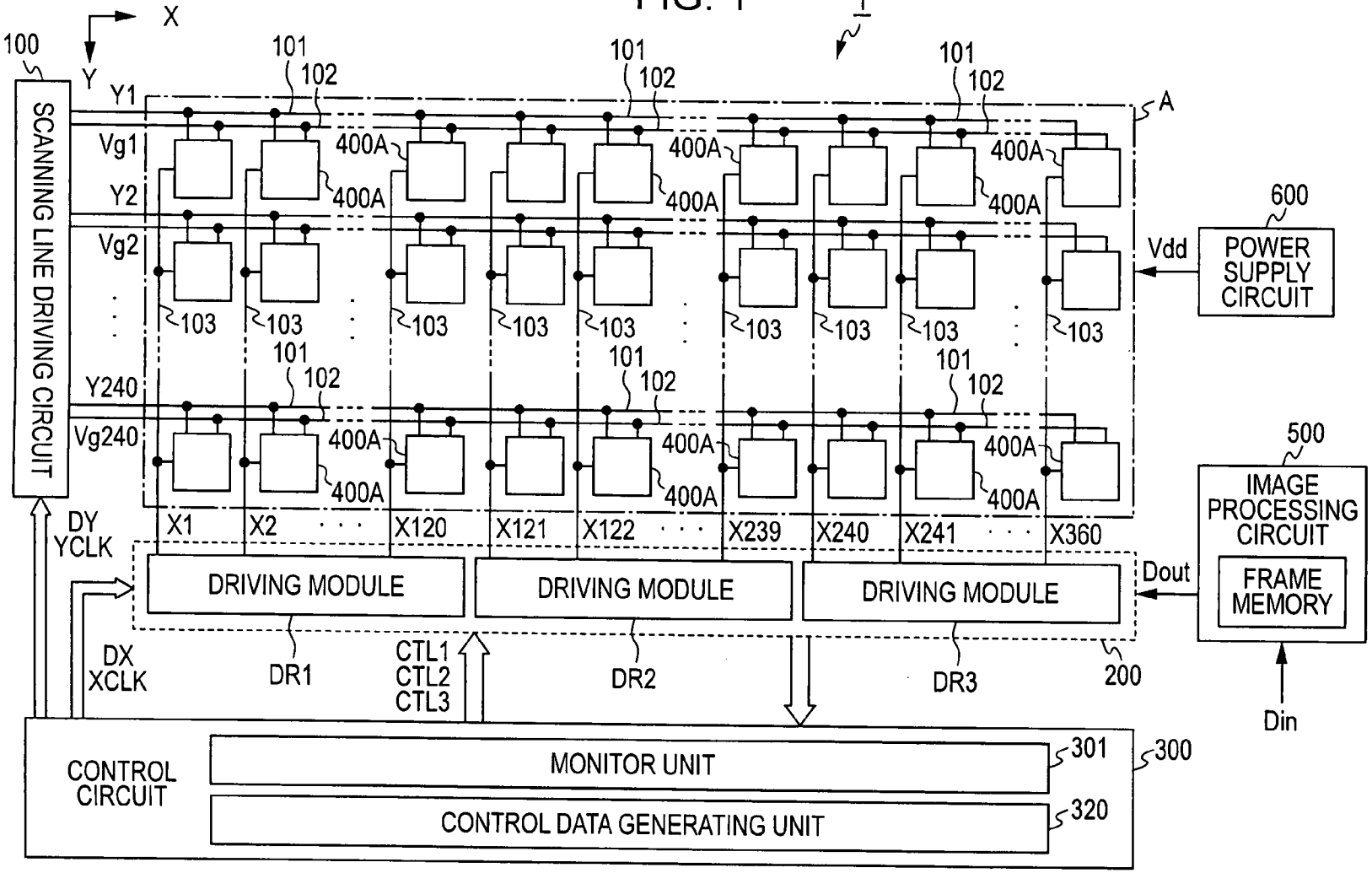
FIG. 1 is a block diagram illustrating the configuration of an electro-optical device in accordance with a first embodiment of the present invention.

FIG. 1 is a block diagram schematically illustrating the configuration of an electro-optical device 1 according to a first embodiment of the present invention. The electro-optical device 1 has a pixel region A, a scanning line driving circuit 100, a data line driving circuit 200, a control circuit 300, an image processing circuit 500, and a power supply circuit 600. Among these components, 240 scanning lines 101 and 240 emission control lines 102 are formed parallel to the X direction in the pixel region A. In addition, 360 data lines 103 are formed parallel to the Y direction orthogonal to the X direction. Further, pixel circuits 400A are provided at intersections between the scanning lines 101 and the data lines 103. Each pixel circuit 400A has an OLED. In addition, a power supply voltage Vdd is supplied to each pixel circuit 400A through a power supply line, which is not shown. In the present embodiment, pixels of 240(Y) by 360(X) are assumed, however, the number thereof may be arbitrary.

Figure 2:
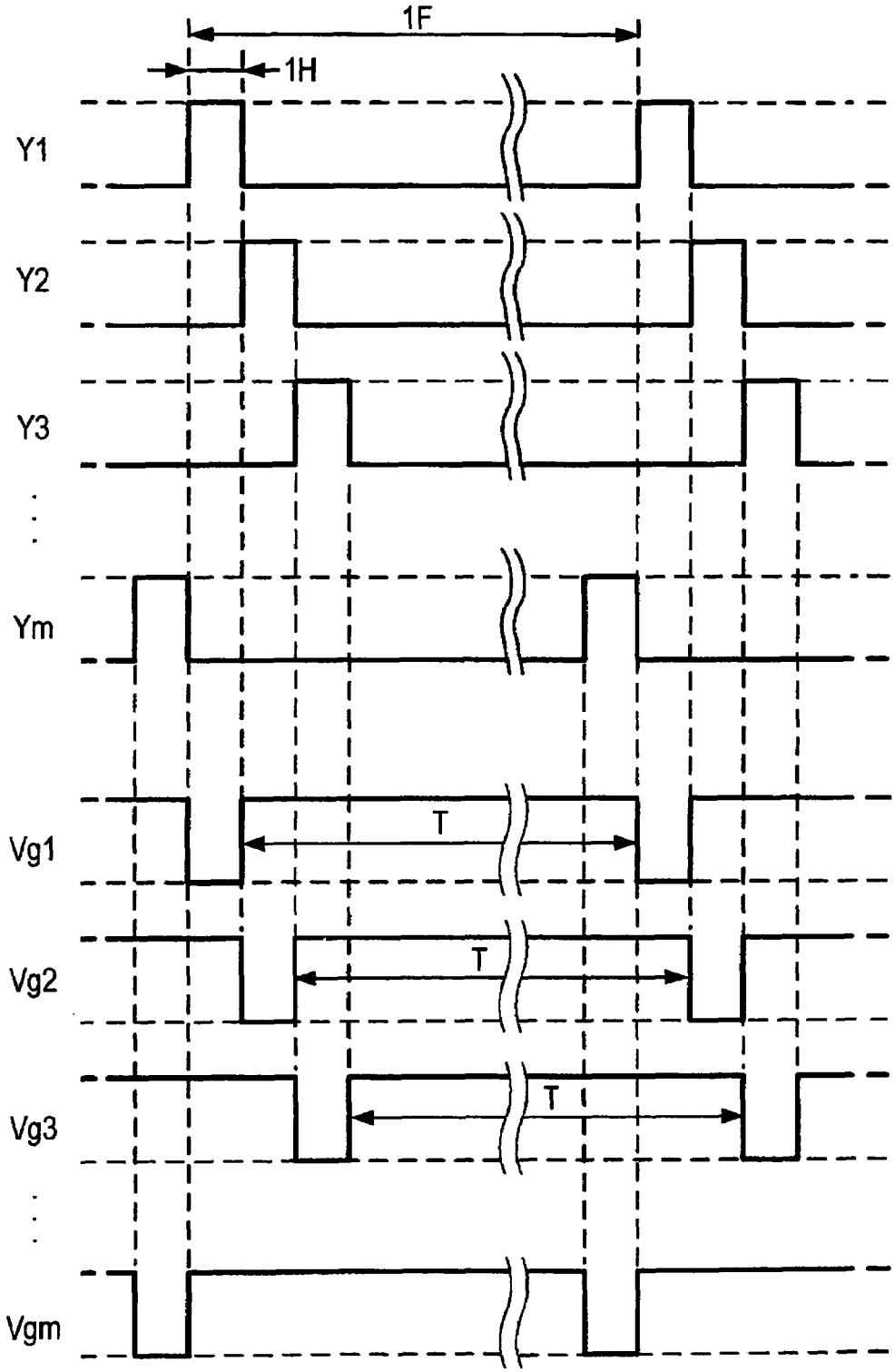
FIG. 2 is a timing chart of a scanning line driving circuit of the electro-optical device.

The scanning line driving circuit 100 generates scanning signals Y1, Y2, Y3, . . . , Y240 for sequentially selecting the plurality of scanning lines 101 and also generates emission control signals Vg1, Vg2, Vg3, . . . , Vg240. The scanning signals Y1 to Y240 and the emission control signals Vg1 to Vg240 are generated by sequentially transmitting a Y transmission start pulse Dy in synchronism with a Y clock signal YCLK. The emission control signals Vg1, Vg2, Vg3, . . . , Vg240 are supplied to the respective pixel circuits 400A through the respective emission control lines 102. FIG. 2 shows an example of a timing chart of the scanning signals Y1 to Y240 and the emission control signals Vg1 to Vg240. The scanning signal Y1 has a pulse having a width corresponding to one horizontal scanning period (1H) from the initial timing of a first vertical scanning period (1F), which is supplied to the first scanning line 101. Subsequently, this pulse is sequentially shifted and is then supplied to the second, third, . . . , 240-th scanning lines 101 as the scanning signals Y2, Y3, . . . , Y240. In general, when the scanning signal Yi supplied to the scanning line 101 in an i-th row (where i is an integer meeting the condition $1 \leqq i \leqq 240$) becomes an H level, it indicates that the scanning line 101 is selected. In addition, for example, signals obtained by inverting the logical levels of the scanning signals Y1, Y2, . . . , Y240 are used as the emission control signals Vg1, Vg2, . . . , Vg240.

The data line driving circuit 200 supplies gray scale signals X1, X2, X3, . . . , Xn to the respective pixel circuits 400A positioned on the selected scanning line 101, based on output gray scale data Dout. In this case, the gray scale signals X1 to Xn are applied as current signals indicating gray-scale brightness. In the present embodiment, the data line driving circuit 200 has three driving modules DR1 to DR3. The driving module DR1 corresponds to the first to 120-th data lines from the left side, the driving module DR2 corresponds to the 121-th to 240-th data lines, and the driving module DR3 corresponds to the 241-th to 360-th data lines 103. In addition, the driving modules DR1 to DR3 have a function of adjusting current conversion gains, based on current control data CTL1 to CTL3, which will be described later in detail.

The control circuit 300 generates various control signals, such as a Y clock signal YCLK, an X clock signal XCLK, an X transmission start pulse DX, and a Y transmission start pulse DY, and outputs them to the scanning line driving circuit 100 and the data line driving circuit 200. In addition, the control circuit 300 has a monitor unit 310 for monitoring currents output from the driving modules DR1 to DR3 when predetermined gray scale data is supplied and a control data generating unit 320 for generating current control data CTL1 to CTL3.

The image processing circuit 500 generates output the gray scale data Dout by performing image processing, such as gamma correction, on the input gray scale data Din supplied from the outside, stores them in a frame memory, and outputs them to the data line driving circuit 200 at a predetermined timing. In addition, the output gray scale data Dout of the present embodiment is a 6-bit signal.

Figure 3:
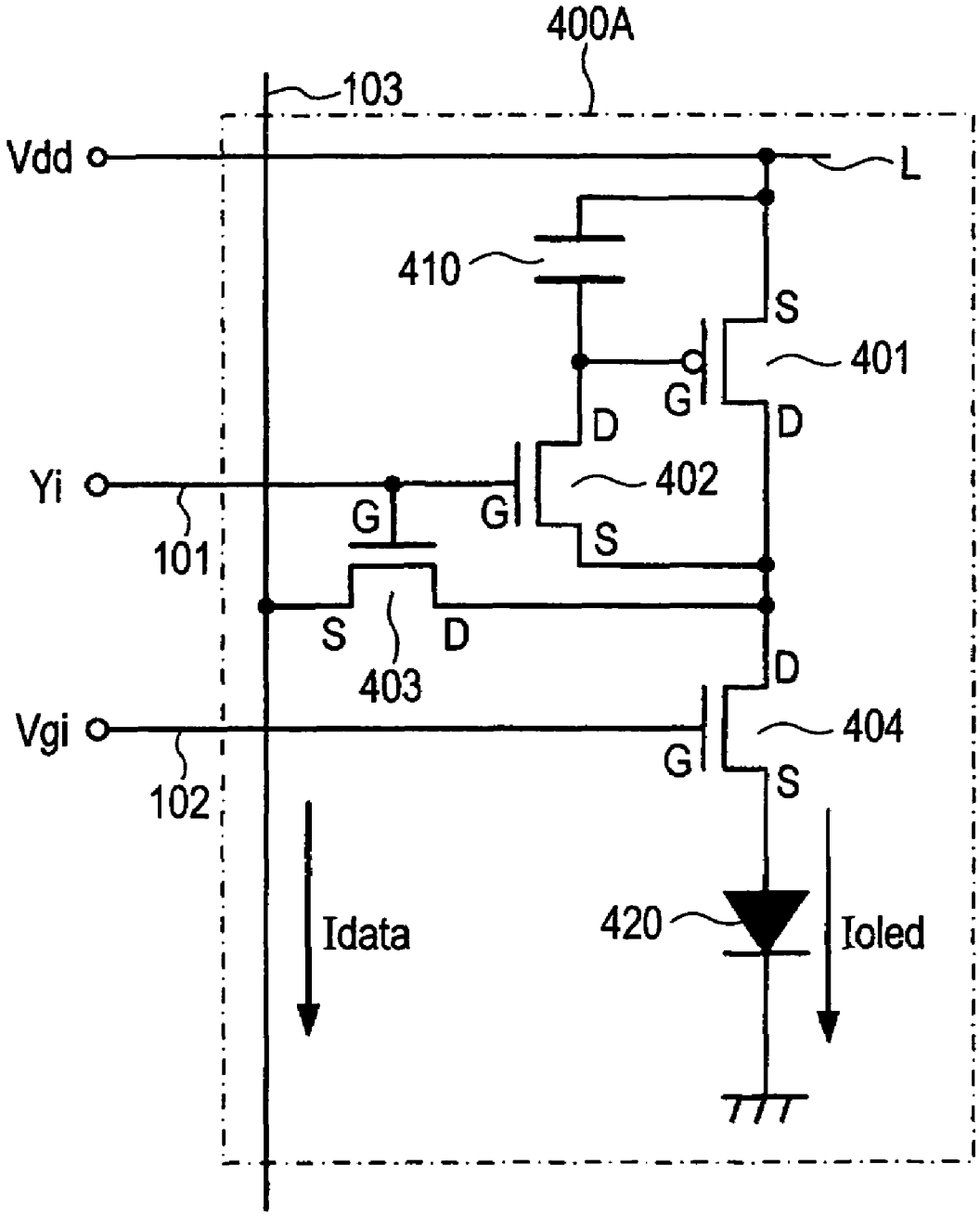
FIG. 3 is a circuit diagram illustrating the configuration of a pixel circuit of the electro-optical device.

Next, the pixel circuit 400A will be described below. FIG. 3 shows a circuit diagram of the pixel circuit 400A. The pixel circuit 400A shown in FIG. 3 corresponds to one disposed in the i-th row to which a power supply voltage Vdd is supplied. The pixel circuit 400A has four TFTs 401 to 404, a capacitive element 410, and an OLED 420. In a process of fabricating the TFTs 401 to 404, laser anneal short is employed to form a polysilicon layer on a glass substrate. In addition, the OLED 420 has a configuration that a light emitting layer is interposed between a positive electrode and a negative electrode. Further, the OLED 420 emits light with brightness corresponding to a forward current. An organic electroluminescent (EL) material corresponding to an emission color is employed for the light emitting layer. In a process of fabricating the light emitting layer, the organic EL material is discharged from an inkjet-type head and is then dried.

The TFT 401, serving as a driving transistor, is a p-channel type, and the TFTs 402 to 404, serving as switching transistors, are n-channel types. A source electrode of the TFT 401 is connected to the power supply line L, and a drain electrode of the TFT 401 is connected to a drain electrode of the TFT 403, a drain electrode of the TFT 404, and a source electrode of the TFT 402.

One end of the capacitive element 410 is connected to the source electrode of the TFT 401 while the other end thereof is connected to the gate electrode of the TFT 401 and the drain electrode of the TFT 402. The gate electrode of the TFT 403 is connected to the scanning line 101, and the source electrode thereof is connected to the data line 103. In addition, the gate electrode of the TFT 402 is connected to the scanning line 101. Meanwhile, the gate electrode of the TFT 404 is connected to the emission control line 102, and the source electrode thereof is connected to the positive electrode of the OLED 420. An emission control signal Vgi is supplied to the gate electrode of the TFT 404 through the emission control line 102. In addition, the negative electrode of the OLED 420 is a common electrode to all the pixel circuits 400A and is supplied with a low (reference) potential from the power supply.

In such a configuration, when the scanning signal Yi becomes an H level, the n-channel TFT 402 is turned on, so that the TFT 401 acts as a diode in which the gate electrode and the drain electrode are connected to each other. When the scanning signal Yi becomes the H level, the n-channel TFT 403 is also turned on, similar to the TFT 402. As a result, a current Idata of the data line driving circuit 200 flows along the following path: power supply line L→TFT 401→TFT 403→data line 103. In this case, electric charges corresponding to the potential of the gate electrode of the TFT 401 are stored in the capacitive element 410.

When the scanning line Yi becomes an L level, both the TFTs 403 and 402 are turned off. In this case, since the input impedance of the gate electrode of the TFT 410 is very high, the state of the electric charges stored in the capacitive element 410 is not changed. The voltage between the gate and the source of the TFT 401 is maintained at the voltage when the current Idata flows. In addition, when the scanning signal Yi becomes the L level, the emission control signal Vgi becomes an H level. Accordingly, the TFT 404 is turned on, which allows injection current Ioled corresponding to the gate voltage to pass between the source and the drain of the TFT 401. More specifically, the current flows along the following path: power supply line L→TFT 401→TFT 404→OLED 420.

In this case, the injection current Ioled flowing through the OLED 420 is determined by the voltage between the gate and the source of the TFT 401. However, the voltage is one held by the capacitive element 410 when the current Idata has flown through the data line 103 by means of the scanning signal Yi having the H level. Accordingly, when the emission control signal Vgi became the H level, the injection current Ioled flowing through the OLED 420 is approximately equal to the current Idata that has previously flown. As such, the pixel circuit 400A defines emission brightness by means of the current Idata, so that it is a current program type circuit.

Figure 4:
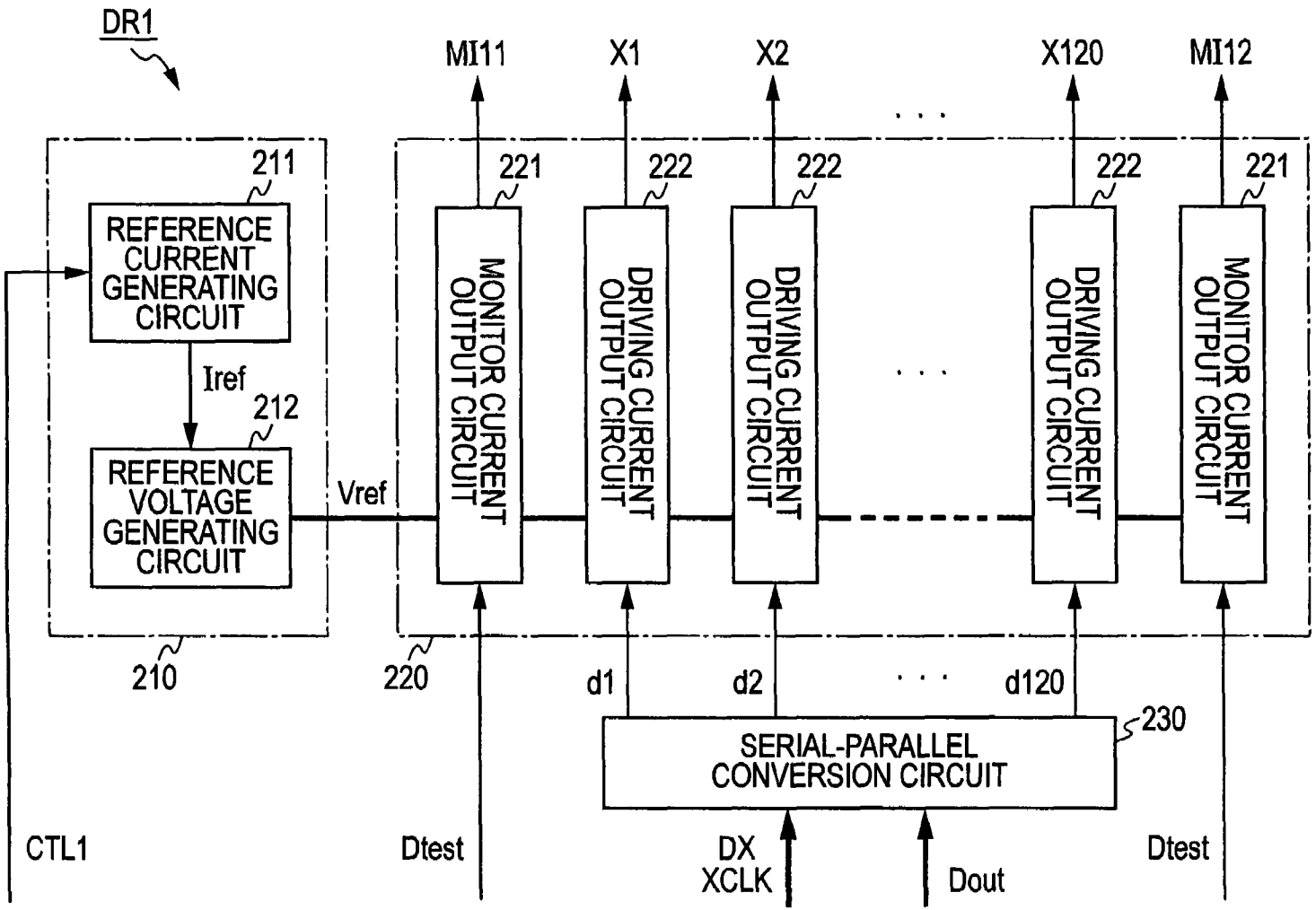
FIG. 4 is a block diagram illustrating the configuration of a driving module of the electro-optical device.

FIG. 4 is a block diagram illustrating a detailed configuration of the driving module DR1 used for the data line driving circuit 200. In addition, the driving modules DR2 and DR3 have the same configuration as that of the driving module DR1, so that a description thereof will be omitted. The driving module DR1 has a current adjusting unit 210, an output unit 220, and a serial-parallel conversion circuit 230. The serial-parallel conversion circuit 230 has a shift register and a latch circuit. The shift register sequentially transmits the X transmission start pulse DX in synchronism with the X clock signal XCLK to generate a dot sequential latch signal. The latch circuit latches the output gray scale data Dout using the latch signal. By means of this configuration, the serial-type output gray scale data Dout are converted into parallel-type gray scale data d1, d2, . . . , d120.

The output unit 220 has two monitor current output circuits 221 and 120 driving current output circuits 222. These current output circuits have the same configuration and are configured such that a reference voltage Vref supplied from the current adjustment unit 210 allows current conversion gains to be batch-adjusted. The 120 driving current output circuits 222 perform digital-to-analog conversion on the gray scale data d1 to d120 to output gray scale signals X1 to X120. The monitor current output circuits 221 are respectively disposed to be adjacent to the right and left ends of the 120 driving current output circuits 222. Test data Dtest may be supplied to one of or both the monitor current output circuits 221. In the present embodiment, the value of the test data Dtest is set to the maximum luminance. Since the output gray scale data Dout is a 6-bit signal, the test data Dtest indicates 63 gray scale levels. In addition, the test data Dtest may be applied from the outside as a portion of the output gray scale data Dout, or may be applied from the data line driving circuit 200.

A monitor current signal MI11 is output from the monitor current output circuit 221 at the left end while a monitor current signal MI12 is output from the monitor current output circuit 221 at the right end. In the actual control, the monitor current signal MI11 of the driving module DR1 is not used. Hereinafter, the monitor current signals output from the monitor current output circuits 221 at the right and left ends of the driving module DR2 are respectively referred to as 'MI22' and 'MI21', and the monitor current signals output from the monitor current output circuits 221 at the right and left ends of the driving module DR3 are respectively referred to as 'MI31' and 'MI32'. In addition, the monitor current signal MI32 is not used for the actual control.

Figure 5:
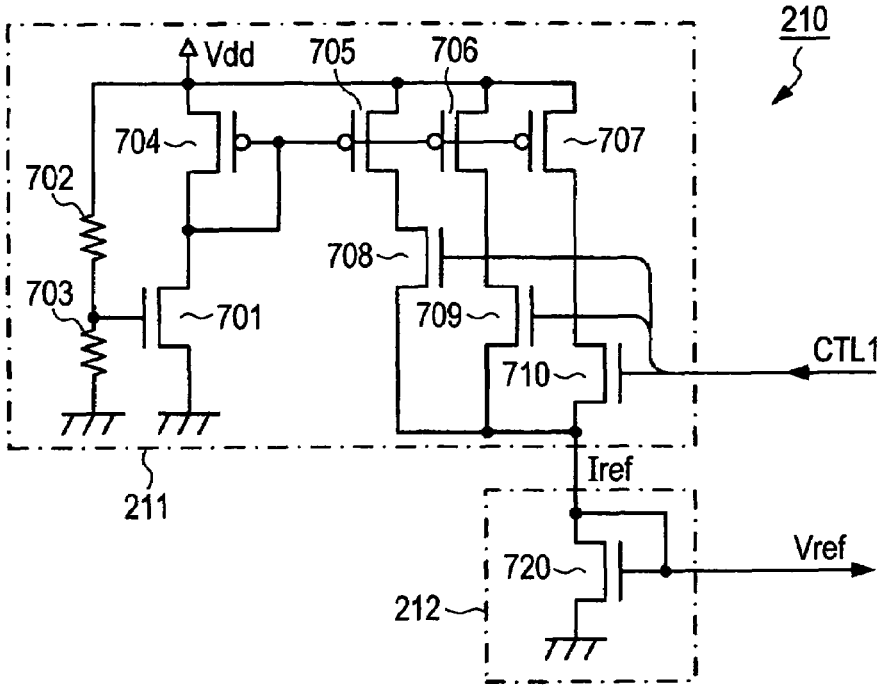
FIG. 5 is a circuit diagram illustrating the configuration of a current adjustment unit provided in the driving module.

FIG. 5 is a detailed circuit diagram of the current adjustment unit 210. A voltage obtained by dividing the power supply voltage Vdd using resistors 702 and 703 is supplied to a gate of a transistor 701 in the reference current generation circuit 211 of the current adjustment unit 210. A current flowing through the transistor 701 is determined by the gate voltage of the transistor 701, and gate voltages of transistors 704 to 707 are determined by the current. Accordingly, the gate voltage of the transistor 701 becomes the reference of the reference current Iref generated by the reference current generation circuit 211. The transistors 704 to 707 constitute a current mirror circuit, and when the sizes of the transistors 705 to 707 are set to have a ratio of 1:2:4 relative to the size of the transistor 704 set as 1. Transistors 708 to 710 operate as switching elements and are turned on/off by means of the three-bit current control data CTL1. Accordingly, the value of the reference current Iref is controlled by the current control data CTL1. The reference voltage generation circuit 212 is constituted by the transistor 720 and converts the reference current Iref into a reference voltage Vref to be output.

Figure 6:
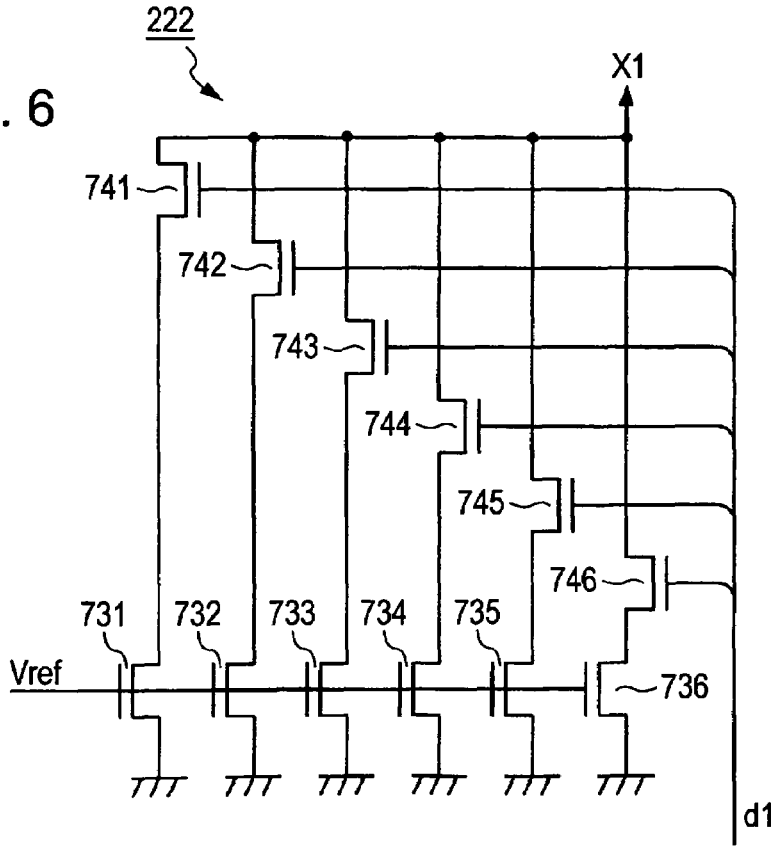
FIG. 6 is a circuit diagram illustrating the configuration of a driving current output circuit provided in the driving module.

FIG. 6 is a detailed circuit diagram of the driving current output circuit 222. In addition, as described above, the monitor current output circuit 221 has the same configuration as the drive current output circuit 222. The drive current output circuit has six transistors 731 to 736 serving as current sources and six transistors 741 to 746 serving as switching elements. The sizes of the transistors 731 to 736 are set to have a ratio of 1:2:4:8:16:32. When 6-bit gray scale data d1 is supplied in such a configuration, the on/off states of the transistors 741 to 746 are controlled corresponding to the respective bits. As a result, the current corresponding to the gray scale value of the gray scale data d1 is supplied to the data line 103 as the gray scale signal X1. In this case, the values of the currents flowing through the respective transistors 731 to 736 are determined by the reference voltage Vref. Accordingly, the current conversion gain is adjusted by the above-described current control data CTL1.

Figure 7:
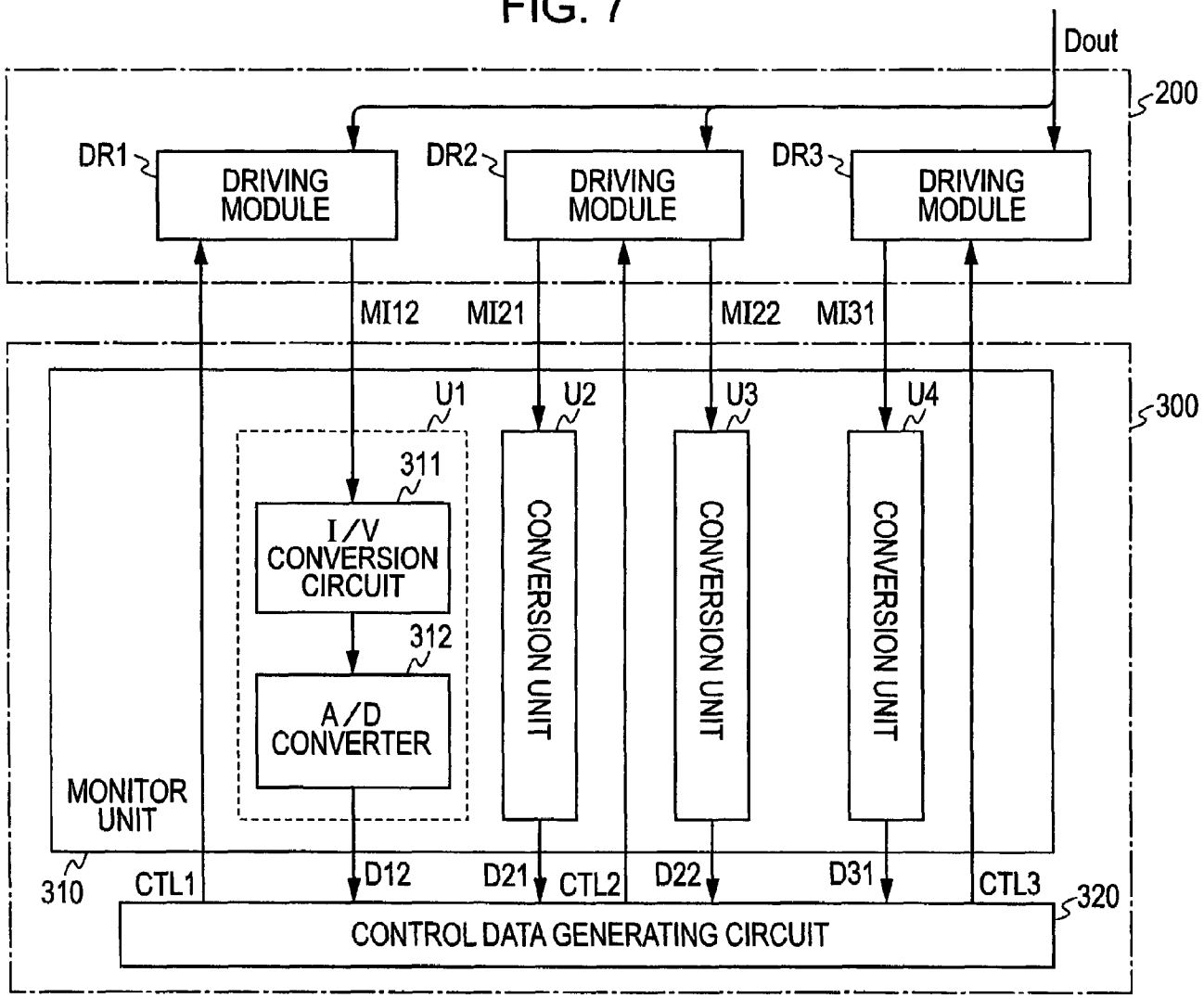
FIG. 7 is a block diagram illustrating a control circuit and peripheral circuits thereof of the electro-optical device.

FIG. 7 shows a control circuit 300 and the peripheral configuration thereof. A monitor unit 310 of the control circuit 300 has four conversion units U1 to U4 as shown in FIG. 7. The conversion unit U1 has an I/V conversion circuit 311 for converting a current into a voltage and an A/D converter 312 for converting a voltage signal into a digital signal. In addition, the conversion units U2 and U3 have the same configuration as the conversion unit U1. The conversion unit U1 converts the monitor current signal MI12 output from the driving module DR1 into a digital signal and outputs the converted signal as monitor data D12. The conversion units U2 and U3 convert the monitor current signals MI21 and MI22 output from the driving module DR2 into digital signals, respectively, and output the converted signals as monitor data D21 and D22. The conversion unit U4 converts the monitor current signal MI31 output from the driving module DR3 into a digital signal and outputs the converted signal as monitor data D31. That is, the current conversion characteristics of the respective driving modules DR1 to DR3 are fed back to a control data generating unit 320.

The control data generating unit 320 controls the current adjustment units 210 of the respective driving modules DR1 to DR3 such that the values of the monitor current signals MI12, MI21, MI22, and MI31 are approximate to each other, based on the monitor data D12, D21, D22, and D31. More specifically, the control data generating unit 320 generates current control data CTL1, CTL2, and CTL3.

Figure 8:
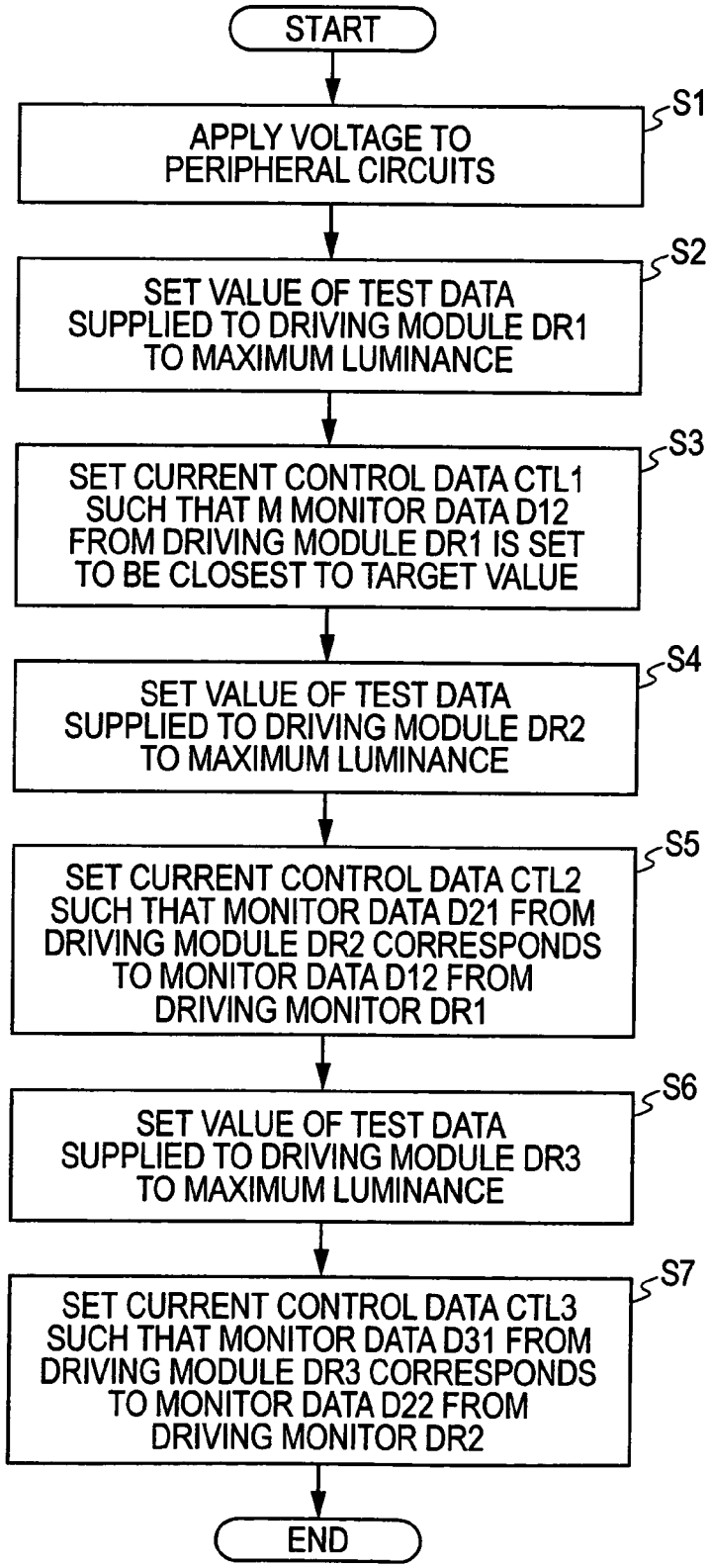
FIG. 8 is a flow chart illustrating an adjustment operation of the electro-optical device.

FIG. 8 illustrates a process of generating the current control data. First, in a state in which power is not applied to the scanning line driving circuit 100 of the electro-optical device 1, a voltage is applied to peripheral circuits, such as the data line driving circuit 200, the control circuit 300, and the image processing circuit 500 (step S1).

Then, the value of the test data Dtest supplied to the driving module DR1 is set to the maximum luminance (in this case, 63 gray scale levels) (step S2). Subsequently, the current control data CTL1 is set such that the monitor data D12 from the driving module DR1 is closest to a desired value (step S3). In this case, the desired value has already been determined as a current value necessary for obtaining predetermined luminance in consideration of the maximum luminance to be displayed by the panel and the efficiency of the OLED 420. However, since the current control data CTL1 is a three-bit digital signal, it includes a minimum of step error. In step S3, the value of the current control data CTL1 is determined such that a minimum error is generated.

Subsequently, the value of the test data Dtest supplied to the driving module DR2 is set to the maximum luminance, that is, the value is set to the same luminance as that of the driving module DR1 (step S4). In this case, the current control data CTL2 is set such that the monitor data D21 from the driving module DR2 corresponds to the monitor data D12 from the driving module DR1 (step S5). In addition, the value of the test data Dtest supplied to the driving module DR3 is set to the maximum luminance (step S6), and the current control data CTL2 is set such that the monitor data D31 from the driving module DR3 corresponds to the monitor data D22 from the driving module DR2 (step S7). The current control data CTL1 to CTL3 generated in this way are stored in a non-volatile memory of the control data generating unit 320 and are read out therefrom to be supplied to the respective driving modules DR1 to DR3 in an ordinary operation.

In the present embodiment as described above, for one of the plurality of driving modules DR1 to DR3, the current conversion gain thereof is adjusted such that the characteristic thereof corresponds to a desired value, and the current conversion gains of the modules adjacent to the one are adjusted such that the current output characteristics of adjacent modules correspond to each other, and these operations are repeated. Accordingly, even when the characteristics of transistors constituting the plurality of driving modules DR1, DR2, and DR3 are different from each other, it is possible to adjust the current conversion gains such that the difference between the current output characteristics does not occur. As a result, the luminance variation between the driving modules DR1, DR2, and DR3 does not occur, which makes it possible to display uniform images.

2. Modification of the First Embodiment

The above-described first embodiment may be modified as follows.

(1) In the first embodiment, the currents flowing through the boundaries between the driving modules DR1 to DR3 are all monitored. However, one of the driving modules DR1 to DR3 may be monitored. In this case, the number of the monitor current output circuits 221 and the number of the conversion units U1 to U4 may be decreased.

Figure 9:
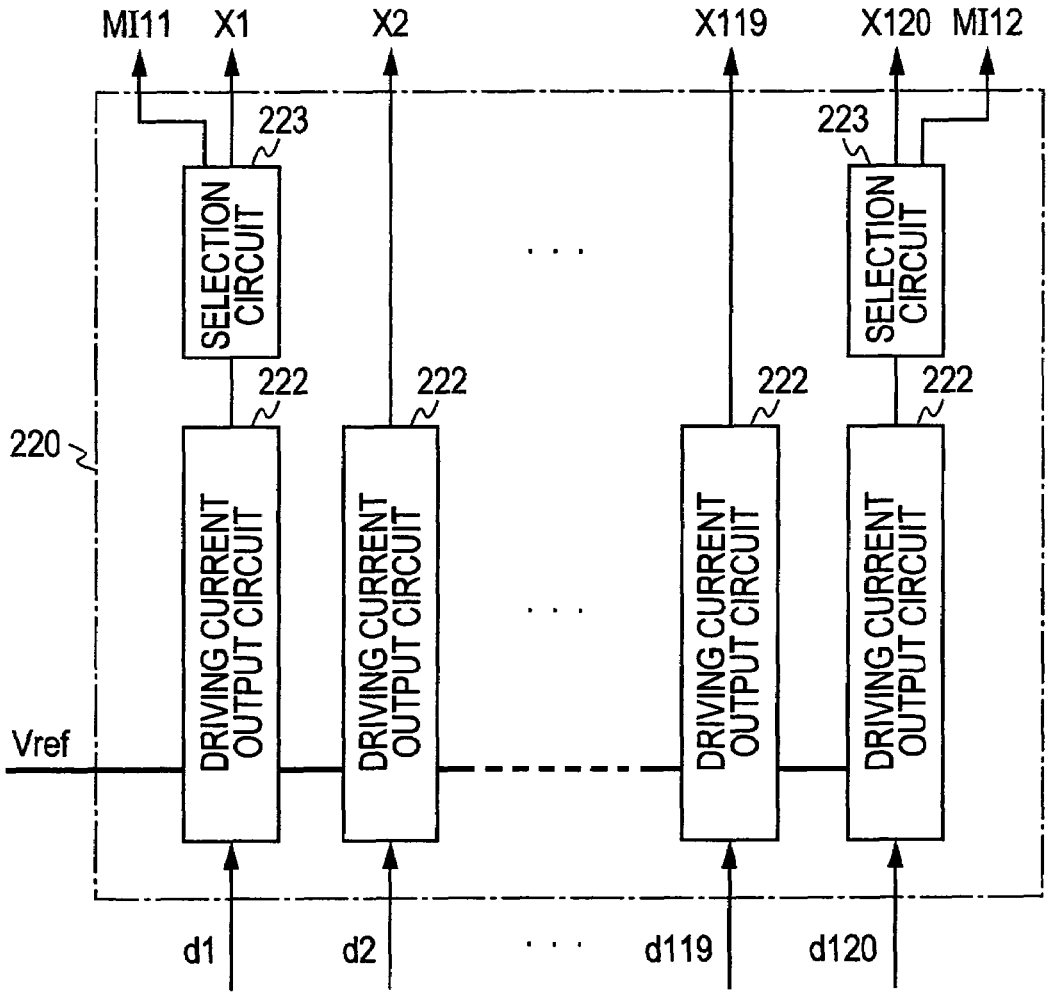
FIG. 9 is a block diagram illustrating the configuration of an output unit in accordance with a modification of the first embodiment.

(2) The above-described output unit 220 is provided with the monitor current output circuit 221 separately from the drive current output circuit 222. However, in the output unit 220, a selection circuit 223 may be provided at the rear end of the drive current output circuit 222 to switch between the output of a monitor current signal and the output of the gray scale signal, as shown in FIG. 9. In this case, since it is not necessary to separately provide the monitor current output circuit 221, the configuration of the output unit 220 may be simplified.

Figure 10:
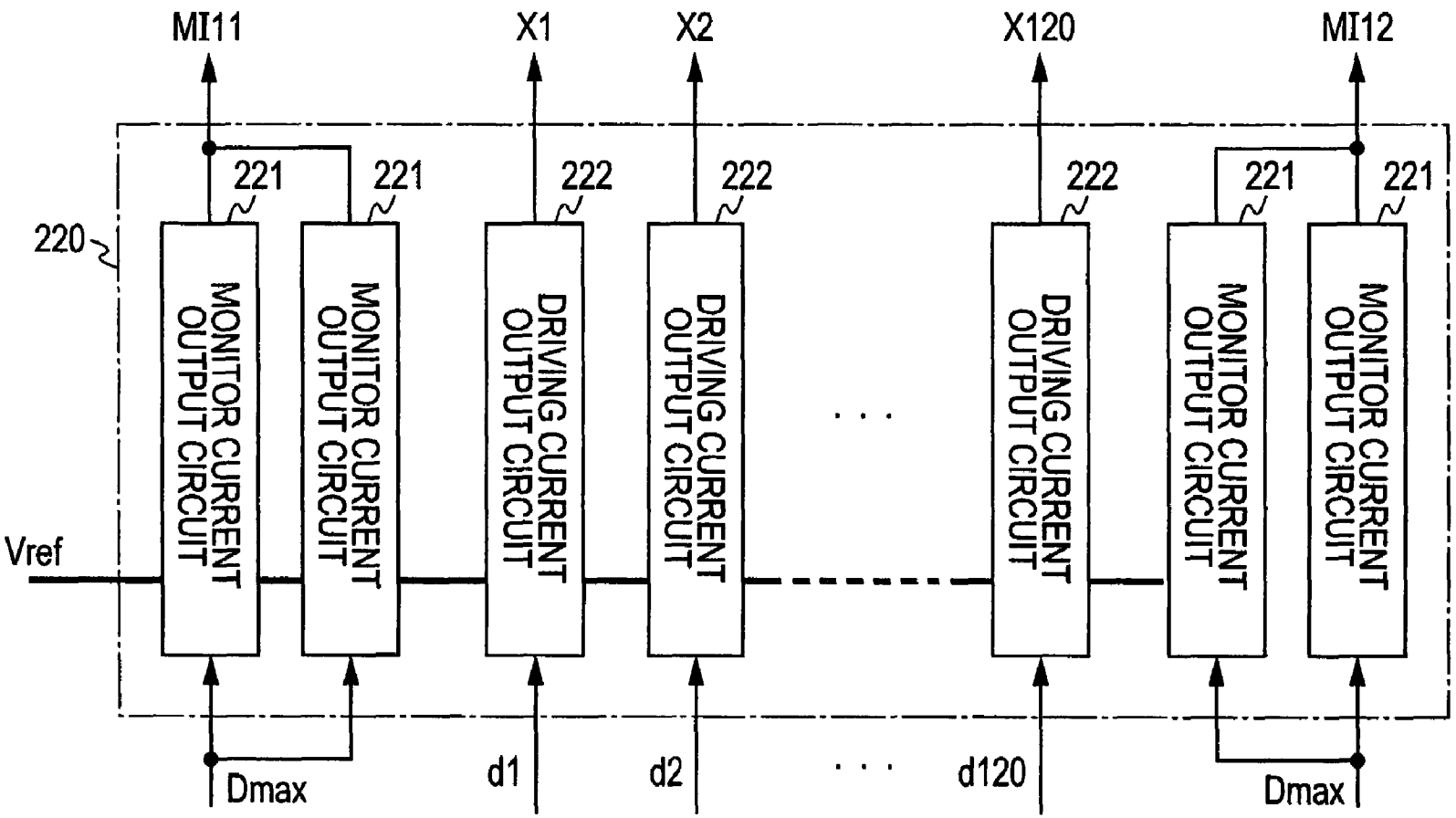
FIG. 10 is a block diagram illustrating another configuration of the output unit in accordance with the modification.

(3) In the above-described output unit 220, the respective monitor current output circuits 221 separately output the monitor current signal. However, it is possible to synthesize the plurality of monitor current signals to output them as shown in FIG. 10. In particular, when the current value of the monitor current signal is small, the signal-to-noise (SN) ratio of the signal becomes problematic. However, the synthesis of the plurality of monitor current signals makes it possible to improve a noise margin and thus to perform high-accuracy measurement.

(4) In the present embodiment, the configuration of the monitor current output circuit 221 is the same as that of the driving current output circuit 222. However, monitor current output circuits having different current gains therefrom may be employed. For example, the monitor current output circuit 221 may current-mirror the reference current of D/A conversion at a ratio of 1:1, or may current-mirror the reference current by ten times or one tenth.

(5) In the above-described monitor current output circuit 221, the current value thereof may be adjusted. For example, when the monitor current output circuit 221 has the same configuration as the drive current output circuit 222, the test data Dtest may be supplied as a portion of the output gray scale data Dout, and the test data Dtest may be separated from the output gray scale data Dout within the driving modules DR1 to DR3. Alternatively, when the monitor current output circuit 221 has the current-mirror function as in the above-mentioned modification, the value of a current amplification rate β may be adjusted.

Figure 11:
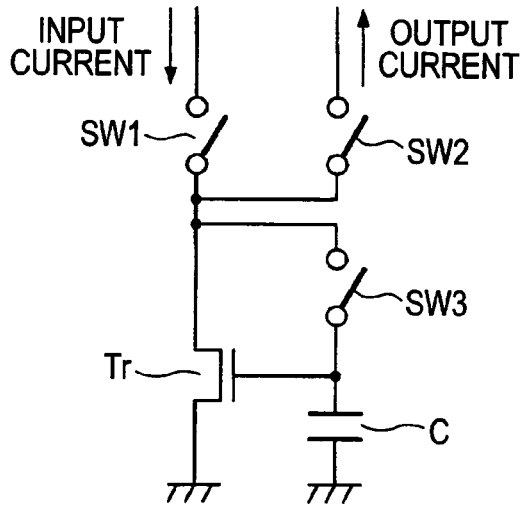
FIG. 11 is a block diagram illustrating the configuration of the output unit composed of circuits other than a current mirror circuit in accordance with the modification.

(6) The output unit 220 is constituted by the current-mirror circuit. However, the output unit 20 may not employ the current-mirror circuit as shown in FIG. 11. The output circuit shown in FIG. 11 has a transistor Tr, a storage capacitor C, and switches SW1 to SW3. At the time of input, the switches SW1 and Sw3 are turned on to allow the storage capacitor C to hold the voltage corresponding to the input current. At the time of output, the switches SW1 and SW3 are turned off to cause the switch SW2 to be turned on. Accordingly, the current corresponding to the voltage held in the storage capacitor C is output as an output current.

Figure 12:
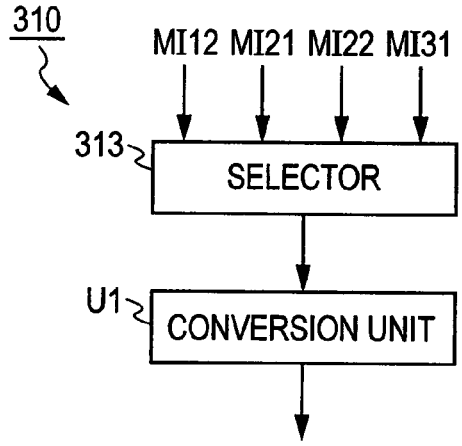
FIG. 12 is a block diagram illustrating the configuration of a monitor unit in accordance with the modification.

(7) In the above-described embodiment, the monitor unit 310 uses the plurality of conversion units U1 to U4. However, the monitor unit 310 may composed of a selector 313 for selecting the monitor current signals MI12, MI21, MI22, and MI31 and one conversion unit U1 as shown in FIG. 12. In this case, the respective monitor current signals MI12, MI21, MI22, and MI31 are selected in a time division manner, and the selected signals are converted into monitor data. Accordingly, it is possible to greatly simplify the configuration of the monitor unit 310.

(8) In the above-described embodiment, the current of the target module for adjustment is adjusted so as to be approximate to the currents output from modules adjacent in this order of the driving module DR1→driving module DR2→driving module DR3. However, all the driving modules DR1 to DR3 may be adjusted to have an absolute reference value. In addition, the absolute reference value may be set to an average value of the currents output from the respective driving modules DR1 to DR3, or may be uniquely set according to the specification of the electro-optical device 1.

(9) In the above-described embodiment, the adjustment of the current conversion gain between the driving modules may be performed immediately after power is applied to the driving modules DR1 to DR3. In addition, by storing the current control data CTL1 to CTL3 in a non-volatile memory, the adjustment may be performed at the time of product shipment. In addition, the adjustment may be performed in an ordinary operation when the monitor current output circuit 221 is separately used. For example, the adjustment may be performed in the vertical blanking period.

(10) In the present embodiment, the gray scale level of the test data Dtest is set to the maximum luminance. However, the level may be set to an intermediate gray scale level. In addition, the current control data CTL1 to CTL3 with respect to the plurality of gray scale levels may be generated, or the average value thereof may be employed.

(11) In the present embodiment, the variation between the driving modules DR1 to DR3 is decreased by adjusting the value of the reference current Iref. However, the reference voltage Vref supplied to the output unit 220 may be directly adjusted. In addition, the gate voltage of the transistor 701 shown in FIG. 5 may be adjusted.

(12) In the present embodiment, the current control data CTL1 to CTL3 is controlled to adjust the current conversion gain of the output unit 220. However, the output gray scale data Dout supplied to the respective driving module DR1 to DR3 may be multiplied by a control coefficient to obtain uniform luminance. In addition, a lookup table for converting the signal level of the output gray scale data Dout may be switched to obtain uniform luminance.

3. Second Embodiment

Figure 13:
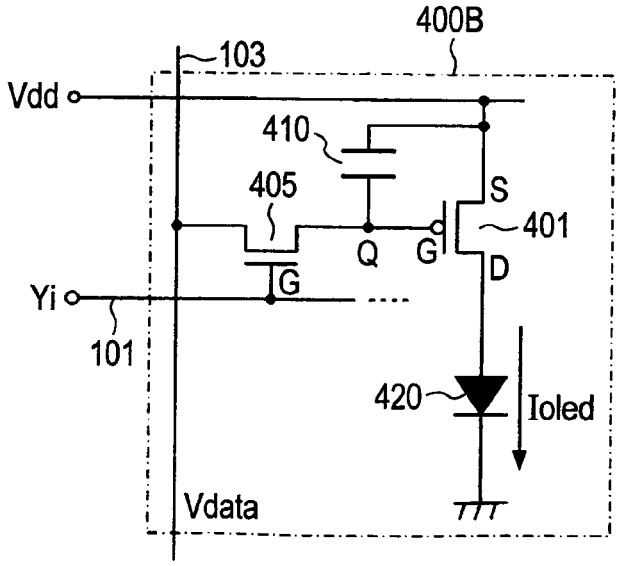
FIG. 13 is a circuit diagram illustrating the configuration of a pixel circuit used for an electro-optical device in accordance with a second embodiment of the present invention.

Next, a second embodiment according to the present invention will be described. An electro-optical device 1 according to the second embodiment differs from the electro-optical device 1 of the first embodiment in that the gray scale signals X1 to X360 are supplied as voltage signals, not as current signals. FIG. 13 shows a pixel circuit 400B of the second embodiment. The pixel circuit 400B shown in FIG. 13 corresponds to a pixel in the i-th row to which a power supply voltage Vdd is supplied. The pixel circuit 400B differs from the above-described pixel circuit 400A in that the TFTs 402 and 403 are removed, a TFT 405 is provided between the gate electrode of the TFT 401 and the data line 103, the gate electrode of the TFT 405 is connected to the scanning line 101, and the drain electrode of the TFT 401 is connected to a positive electrode of the OLED 420.

In such a configuration, when the scanning signal Yi becomes an H level, the n-channel TFT 405 is turned on, so that a voltage of a connection point Q is equal to the voltage Vdata. In this case, electric charges corresponding to a voltage Vdd-Vdata are stored in the capacitive element 410. Subsequently, when the scanning signal Yi becomes an L level, the TFT 405 is turned off. Since the input impedance of the gate electrode of the TFT 401 is very high, the state of electric charges stored in the capacitive element 410 is not changed. The voltage between the gate and the source of the TFT 401 is maintained at the voltage (Vdd-Vdata) when the voltage Vdata is applied. Since the current Ioled flowing through the OLED 420 is determined by the voltage between the gate and the source of the TFT 401, the current Ioled corresponding to the voltage Vdata flows. Such a pixel circuit 400B defines emission luminance by means of the voltage Vdata, so that it is a voltage program type circuit. That is, the gray scale signals X1 to X360 of the second embodiment are supplied as voltage signals.

Figure 14:
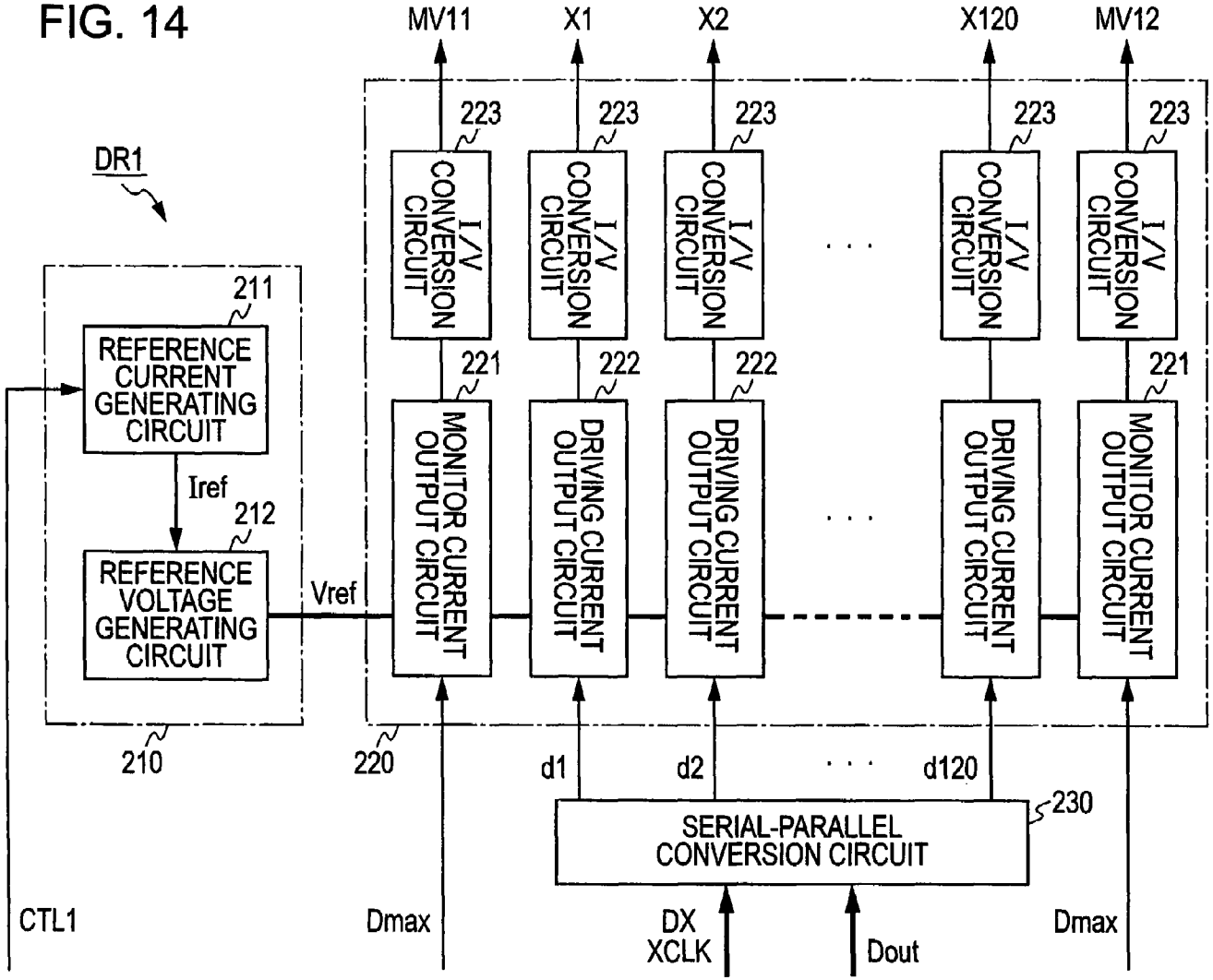
FIG. 14 is a block diagram illustrating the configuration of a driving module used for the electro-optical device according to the second embodiment.

FIG. 14 shows a block diagram of the driving module DR1 used in the second embodiment. In addition, the driving modules DR2 and DR3 have the same configuration as the driving module DR1. The driving module DR1 of the second embodiment differs from that of the first embodiment in that I/V conversion circuits 223 are provided at the rear ends of the monitor current output circuit 221 and the drive current output circuit 222. The I/V conversion circuit 223 converts a current signal into a voltage signal and outputs the converted signal. In the present embodiment, a monitor voltage signal MV11 is output from the I/V conversion circuit 223 at the left end, and a monitor voltage signal MV12 is output from the I/V conversion circuit 223 at the right end. In addition, since the voltage signals are supplied to the conversion units U1 to U4 in the second embodiment, the I/V conversion circuit 311 is not needed, and the monitor voltage signal MV12 and so forth is directly supplied to the D/A converter 312.

In the case of the electro-optical device 1 which employs the voltage program type pixel circuits 400B, the variation between the driving modules DR1 to DR3 may also be reduced by adjusting the voltage conversion gains as in the first embodiment. Accordingly, it is possible to make display luminance uniform when the data lines 103 are driven using a plurality of driving modules.

In the above-described second embodiment, a voltage is generated from a current and is then output. However, the present invention is not limited thereto, but the driving module may have the voltage output type D/A converter used for a typical liquid crystal driver. In the case of the driving module, it is possible to obtain uniform luminance by adjusting a voltage of a current, which is the reference of the D/A conversion, or by adjusting the gain of the output gray scale data Dout for every driving module, not by adjusting the voltage conversion gains using the current control data CTL1 to CTL3. In addition, the modifications of the first embodiment which may be applied to the second embodiment by substituting the voltage for the current.

4. Applications

In the above-described embodiments, the electro-optical device having the OLED 420 made of an organic EL material as an electro-optical material has been described. However, materials other than the organic EL material may also be employed to the present invention. The electro-optical material is a material whose an optical property, such as transmittance or luminance, is changed in response to the supplied electric signal (current signal or voltage signal). For example, the present invention may also be applied to various electro-optical panels, such as a display panel using liquid crystal or light emitting polymer as an electro-optical material, an electrophoresis display panel using micro capsules each containing a colored liquid material and white particles dispersed in the liquid material as the electro-optical material, a twist ball display panel using twist balls in which different colors are applied for regions having different polarities as the electro-optical material, a toner display panel using a black toner as an electro-optical material, and a plasma display panel using a high-pressure gas, such as helium or neon, as an electro-optical material.

Figure 15:
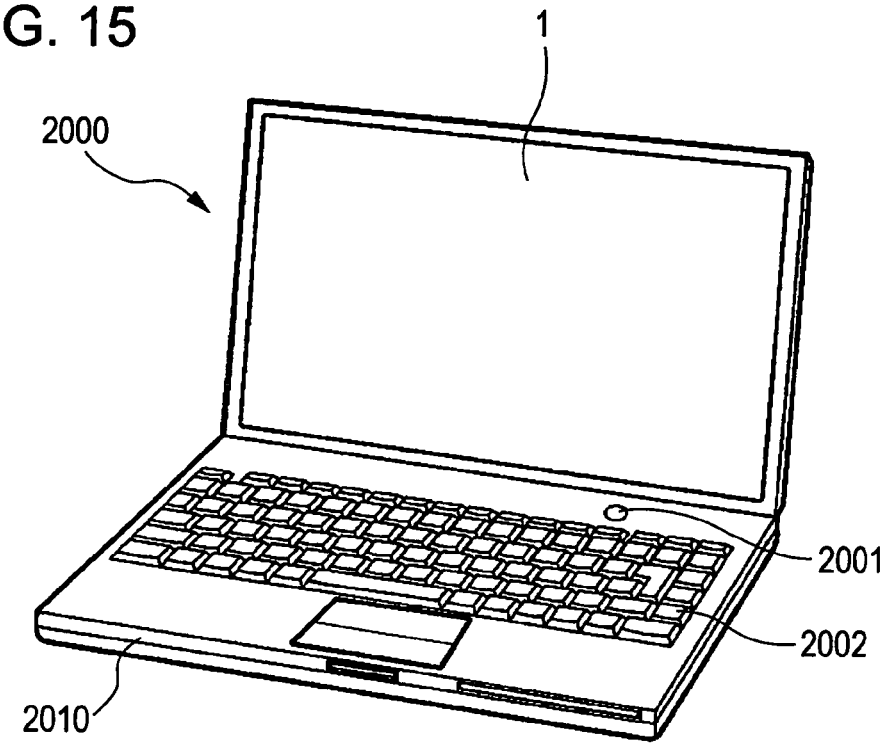
FIG. 15 is a perspective view illustrating the configuration of a mobile personal computer to which the electro-optical device is applied.

Next, an electronic apparatus to which the electro-optical device 1 according to the above-described embodiment or the modification is applied will be described. FIG. 15 shows the configuration of a mobile personal computer to which the electro-optical device 1 is applied. A personal computer 2000 has the electro-optical device 1 as a display unit and a main body 2010. A power supply switch 2001 and a keyboard 2002 are provided in the main body 2010. Since this electro-optical device uses the OLED 420, the electro-optical device can display an image at a wide view angle.

Figure 16:
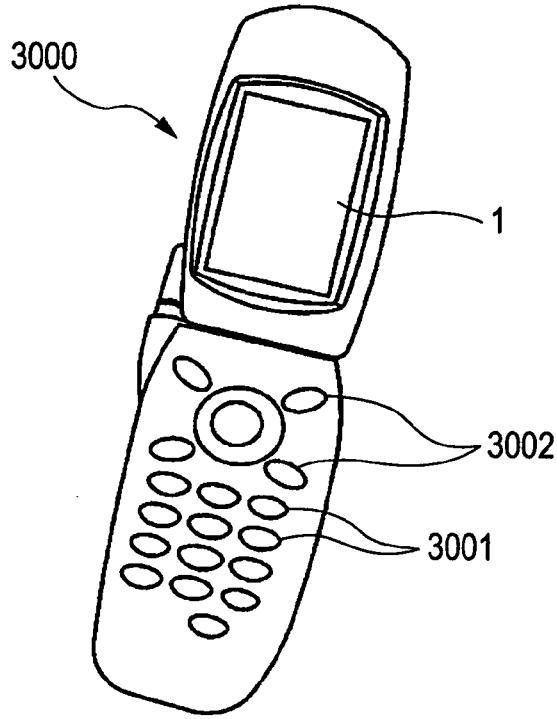
FIG. 16 is a perspective view illustrating the configuration of a cellular phone to which the electro-optical device is applied.

FIG. 16 shows the configuration of a cellular phone to which the electro-optical device 1 is applied. A cellular phone 3000 has a plurality of manipulating buttons 3001, scroll buttons 3002, and the electro-optical device 1 as a display unit. An image displayed on the electro-optical device 1 is scrolled by manipulating the scroll buttons 3002.

Figure 17:
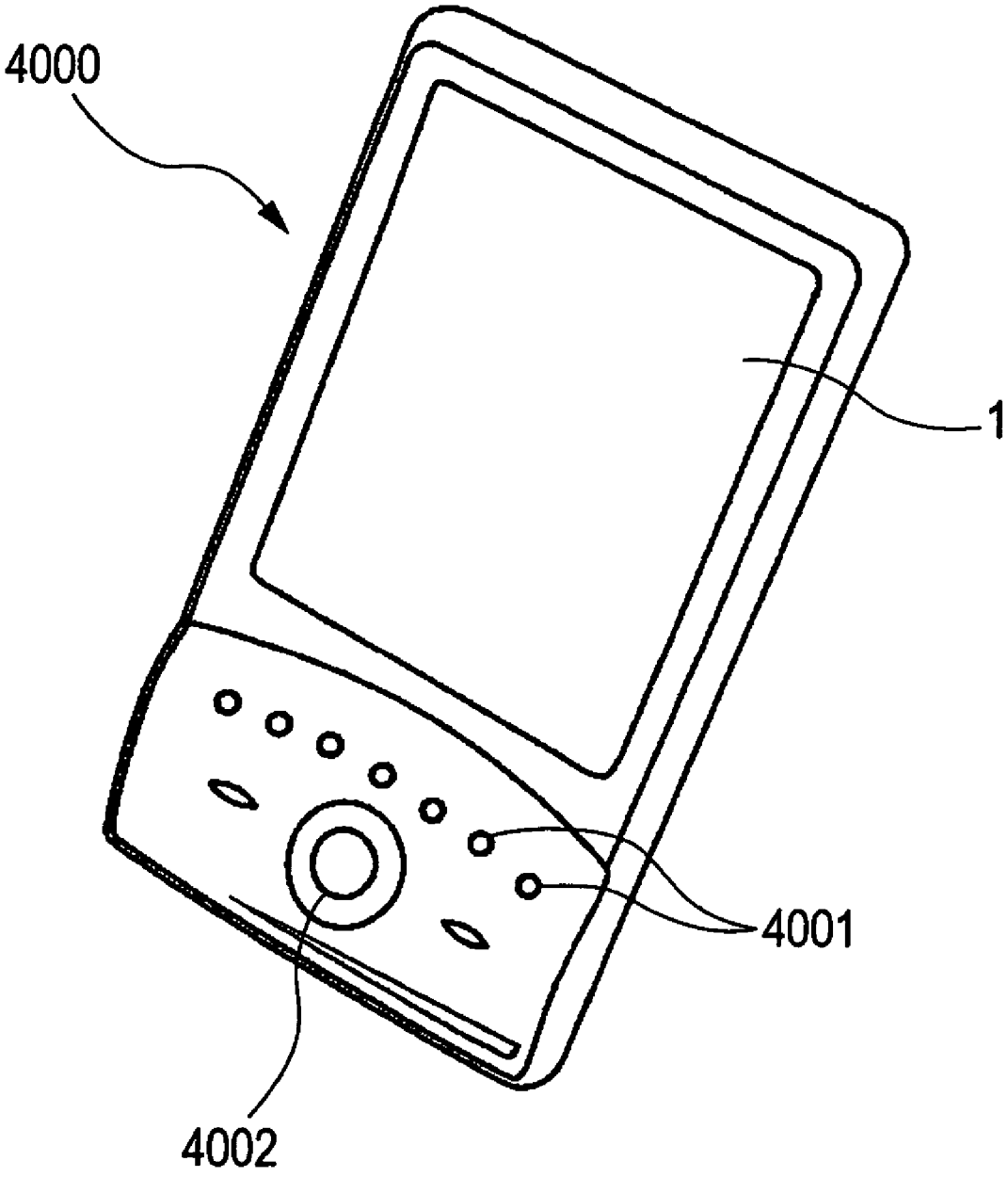
FIG. 17 is a perspective view illustrating the configuration of a portable digital assistant to which the electro-optical device is applied.

FIG. 17 shows the configuration of a personal digital assistant (PDA) to which the electro-optical device 1 is applied. A PDA 4000 has a plurality of manipulating buttons 4001, a power supply button 4002, and the electro-optical device 1 as a display unit. When the power supply unit 4002 is manipulated, various information items, such as an address list and a schedule window, are displayed on the electro-optical device 1.

Further, in addition to the electronic apparatuses shown in FIGS. 15 to 17, the electro-optical device 1 according to the present invention may be applied to various apparatuses, such as a digital camera, a liquid crystal TV, a view finder-type and monitor-direct-view-type video tape recorder, a car navigation apparatus, a pager, an electronic organizer, a calculator, a word process, a workstation, a television phone, a POS terminal, and an apparatus equipped with a touch panel. Furthermore, the above-described electro-optical device may be applied to the display units of these various electronic apparatuses.

What is claimed is:

1. A current supply device comprising:

a plurality of the current supply circuits, the plurality of the current supply circuits comprising:

a plurality of current output circuits for respectively supplying current signals to targets to be driven;

one or more monitor current output circuits for outputting monitor current signals; and a current adjusting circuit for collectively adjusting gains of the one or more monitor current output circuits and the plurality of current output circuits, the current adjusting circuit supplying an adjusted reference voltage to the plurality of current output circuits and the one or more monitor current output circuits, and each of the current output circuits including:

a plurality of current sources for respectively outputting currents based on the reference voltage; and selection output means for selecting the respective currents output from the plurality of current sources, based on input data, and for synthesizing the selected currents to output them; and control means for controlling the current adjusting circuits of the plurality of current supply circuits such that the values of the plurality of monitor current signals are close to each other, based on the plurality of monitor current signals output from the plurality of current supply circuits, wherein the control means has a plurality of conversion means each converting each of the monitor current signals into a digital signal to output it as monitor data, and controls the current adjusting circuits of the plurality of current supply circuits such that the values of the plurality of monitor current signals are close to each other, based on the respective monitor data output from the plurality of conversion means.

2. A current supply device comprising:

a plurality of the current supply circuits, the plurality of the current supply circuits comprising:

a plurality of current output circuits for respectively supplying current signals to targets to be driven;

one or more monitor current output circuits for outputting monitor current signals; and a current adjusting circuit for collectively adjusting gains of the one or more monitor current output circuits and the plurality of current output circuits, the current adjusting circuit supplying an adjusted reference voltage to the plurality of current output circuits and the one or more monitor current output circuits, and each of the current output circuits including:

a plurality of current sources for respectively outputting currents based on the reference voltage; and selection output means for selecting the respective currents output from the plurality of current sources, based on input data, and for synthesizing the selected currents to output them; and control means for controlling the current adjusting circuits of the plurality of current supply circuits such that the values of the plurality of monitor current signals are close to each other, based on the plurality of monitor current signals output from the plurality of current supply circuits, wherein the control means includes:

selection means for sequentially selecting the plurality of monitor current signals to output them; and conversion means for converting the monitor current signals output from the selection means into digital signals to output them as monitor data, and the control means controls the current adjusting circuits of the plurality of current supply circuits such that the values of the plurality of monitor current signals are close to each other, based on the monitor data output from the conversion means.

3. A voltage supply device comprising:

a plurality of the voltage supply circuits, each of the plurality of the voltage supply circuits comprising:

a plurality of voltage output circuits for respectively supplying voltage signals to targets to be driven;

one or more monitor voltage output circuits for outputting monitor voltage signals;

a voltage adjusting circuit for collectively adjusting gains of the one or more monitor voltage output circuits and the plurality of voltage output circuits; and variable means for varying the level of the monitor voltage signals to output them to an outside; and control means for controlling the voltage adjusting circuits of the plurality of voltage supply circuits such that the values of the plurality of monitor voltage signals are close to each other, based on the plurality of monitor voltage signals output from the plurality of voltage supply circuits, wherein the control means has a plurality of conversion means each converting each of the monitor voltage signals into a digital signal to output it as monitor data, and controls the voltage adjusting circuits of the plurality of voltage supply circuits such that the values of the plurality of monitor voltage signals are close to each other, based on the respective monitor data output from the plurality of conversion means.

4. A voltage supply device comprising:

a plurality of the voltage supply circuits, each of the plurality of the voltage supply circuits comprising:

a plurality of voltage output circuits for respectively supplying voltage signals to targets to be driven;

one or more monitor voltage output circuits for outputting monitor voltage signals;

a voltage adjusting circuit for collectively adjusting gains of the one or more monitor voltage output circuits and the plurality of voltage output circuits; and variable means for varying the level of the monitor voltage signals to output them to an outside; and control means for controlling the voltage adjusting circuits of the plurality of voltage supply circuits such that the values of the plurality of monitor voltage signals are close to each other, based on the plurality of monitor voltage signals output from the plurality of voltage supply circuits, wherein the control means includes:

selection means for sequentially selecting the plurality of monitor voltage signals to output them; and conversion means for converting the monitor voltage signals output from the selection means into digital signals to output them as monitor data, and the control means controls the voltage adjusting circuits of the plurality of voltage supply circuits such that the values of the plurality of monitor voltage signals are close to each other, based on the monitor data output from the conversion means.

* * * * *